US005390911A

United States Patent [19]

Schmid

[11] Patent Number: 5,390,911

[45] Date of Patent: Feb. 21, 1995

[54] DEVICE FOR CONVEYING SHEETS FROM A PRINTING PRESS TO A SHEET PILE

[75] Inventor: Gotthard Schmid, Nussloch, Germany

[73] Assignee: Heidelberger Druckmaschinen AG, Heidelberg, Germany

[21] Appl. No.: 185,592

[22] Filed: Jan. 21, 1994

[30] Foreign Application Priority Data

Jan. 27, 1993 [DE] Germany ..... 4302127

[51] Int. Cl.[6] ..... B65H 39/10

[52] U.S. Cl. ..... 271/300; 271/197; 271/204; 271/207; 198/408

[58] Field of Search ..... 271/296, 300, 196, 197, 271/204, 206, 207; 198/408

[56] References Cited

U.S. PATENT DOCUMENTS

| | | | |
|---|---|---|---|
| 2,233,850 | 3/1941 | Rapley | 198/408 |
| 3,191,928 | 6/1965 | Neiden et al. | 271/300 |
| 3,216,347 | 11/1965 | Bradley | 271/300 |
| 4,157,177 | 6/1979 | Strecker | 271/197 |
| 4,479,645 | 10/1984 | Pollich . | |
| 4,643,414 | 2/1987 | Weisgerber | 271/206 |
| 4,761,003 | 8/1988 | Barrois et al. | 271/300 |
| 4,905,843 | 3/1990 | Holbert | 271/197 |
| 5,158,278 | 10/1992 | Auf der Mauer | 271/197 |

FOREIGN PATENT DOCUMENTS

| | | |
|---|---|---|
| 2746171 | 12/1978 | Germany . |
| 3113750 | 10/1982 | Germany . |

*Primary Examiner*—H. Grant Skaggs
*Attorney, Agent, or Firm*—Herbert L. Lerner; Laurence A. Greenberg

[57] ABSTRACT

Device for conveying sheets from a printing press to a sheet pile includes revolving endless conveyor members looped about at least two rotating members having respective horizontal axes of rotation disposed parallel to one another, one of the rotating members being disposed at a location remote from the printing press, mechanical grippers carried by the endless conveyor members for gripping only respective leading edges of sheets, the endless conveyor members having respective upper sides moving along a conveying path in a given conveying direction for carrying thereon sheets conveyable away from the printing press, revolving endless guiding members disposed over part of the conveying path along and adjacent the upper side of the endless conveyor members and along a part of the endless conveyor members looped about the one of the rotating members disposed at the location of the endless conveyor members remote from the printing press, and pneumatic equipment disposed along the endless guiding members for exerting a force in a direction substantially perpendicular to the conveying direction upon the respective sheets being conveyed, the endless conveyor members having an underside, and the sheet pile being disposed below the underside of the endless conveyor members.

14 Claims, 1 Drawing Sheet

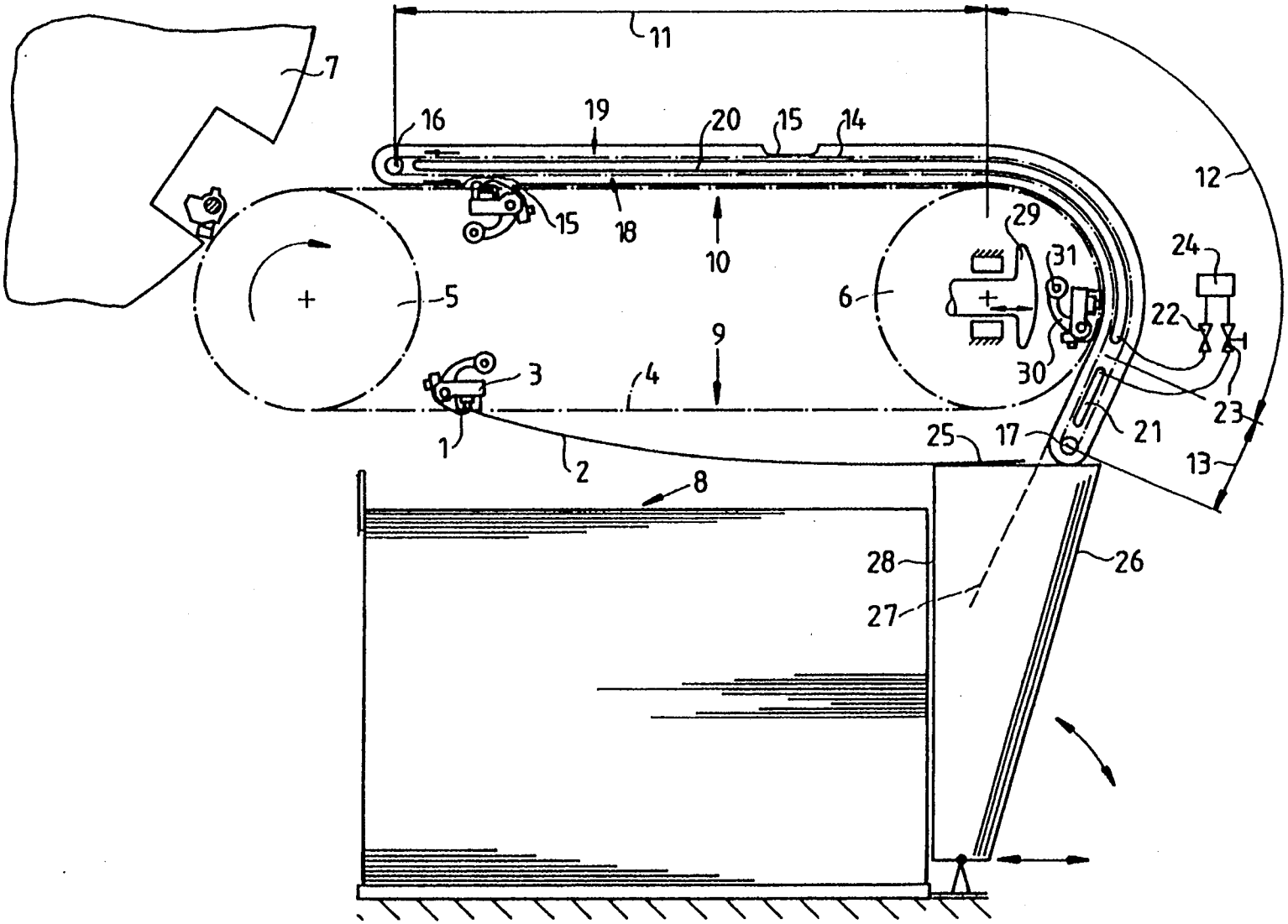
1
2
3
4
5
6
7
8
9
10
11
12
13
14
15
16
17
18
19
20
21
22
23
24
25
26
27
28
29
30
31

DEVICE FOR CONVEYING SHEETS FROM A PRINTING PRESS TO A SHEET PILE

The invention relates to a device for conveying sheets from a printing press to a sheet pile and, more particularly, to a delivery for sheet-fed printing presses wherein sheets are held by respective front or leading edges thereof in grippers which are disposed on moving endless chains or belts. The chains or belts are looped about rotating members having respective axes of rotation disposed horizontally and parallel to one another; one of the rotating members, such as a sprocket wheel, being couplable to a suitable drive. The invention also relates to a delivery wherein sheets are conveyed away from the printing press in an upper side or strand of the chains or belts carrying the grippers. For assisting in the sheet transport, moving endless tapes, belts or chains, with which one side of each sheet is in physical contact, are provided in the device of the foregoing general type.

A number of so-called chain deliveries or suction belt deliveries have become known heretofore, wherein sheets are transported, either in a gripper bite or closure or due to the action of suction air in connection with a suction belt, from a printing press onto a sheet pile. In a special type of deliveries, the sheet is conveyed on a lower side or strand of the delivery chains or suction belts (published German Patent Documents DE 31 13 750 A1 and DE 27 46 171 A1).

In a further type of deliveries, the sheet, due to the construction of the printing press, is conveyed on the upper side of a chain delivery. In such conveyor devices, there is a danger that the freshly printed sheets may collide with parts of the respective conveyor device, and thereby impair the print quality particularly of a sheet which has been printed on both sides thereof. In such conveyor devices, costly sheet guiding devices aided by blower or suction devices are therefore provided, which are supposed to lessen the danger of collision. In conventional devices, this is only incompletely successful, because the sheet is guided only by the front or leading edge thereof, while the rear or trailing edge thereof travels freely so that the rear or trailing edge hangs freely downwardly at low machine speed and flutters at high machine speed. Such devices are therefore unable to convey reliably sheets having the entire range of sheet thicknesses over the entire range of printing-press speed. Such a sheet guidance proves to be especially critical whenever the sheets are to be delivered to a sheet pile located below the delivery chains, because the direction of travel or motion of sheets must then be reversed.

It is accordingly an object of the invention to provide a device for conveying sheets from a printing press to a sheet pile which permits sheets to be-conveyed on an upper side of gripper-transporting chains or belts, with a reduced or eliminated danger of collision thereof.

With the foregoing and other objects in view, there is provided, in accordance with the invention, a device for conveying sheets from a printing press to a sheet pile, comprising revolving endless conveyor members looped about at least two rotating members having respective horizontal axes of rotation disposed parallel to one another, one of the rotating members being disposed at a location remote from the printing press, mechanical grippers carried by the endless conveyor members for gripping only respective leading edges of sheets, the endless conveyor members having respective upper sides moving along a conveying path in a given conveying direction for carrying thereon sheets conveyable away from the printing press, revolving endless guiding members disposed over part of the conveying path along and adjacent the upper side of the endless conveyor members and along a part of the endless conveyor members looped about the one of the rotating members disposed at the location of the endless conveyor members remote from the printing press, and pneumatic means disposed along the endless guiding members for exerting a force in a direction substantially perpendicular to the conveying direction upon the respective sheets being conveyed, the endless conveyor members having an underside, and the sheet pile being disposed below the underside of the endless conveyor members.

In accordance with another feature of the invention, each of the endless guiding members is either a tape, a belt or a chain.

In addition to the grippers, which are disposed on moving or revolving endless conveyor members such as chains or belts, there are thus provided endless guiding members, such as tapes, belts or chains moving in the same direction as the upper side of the endless conveyor members and being in contact with what subsequently becomes the underside of the respective sheet when it comes to rest on the sheet pile. The moving tapes, belts or chains of the endless guiding members are disposed over a length of the conveying path along the upper side of the endless conveyor members and along a wrapping or looped region of the chains or belts transporting the grippers. A blower or suction device is also assigned to the moving tapes, belts or chains of the endless guiding members, and exerts a force, in a direction perpendicular to the conveying direction, upon the respective sheets being conveyed. The sheet pile is located below the underside of the chains or belts transporting the grippers.

The device according to the invention ensures that, despite the necessary reversal of direction of the sheets, they are transported onto the sheet pile or stack from the printing press without collision. The sheets are guided by the moving tapes, belts or chains of the endless guiding members on the upper side and in the wrapping or looped region of the endless conveyor members about the respective rotatable member, such as a sprocket wheel in the case of an endless chain.

In accordance with a further feature of the invention, the endless guiding members are revolvable at a speed at most substantially equal to the speed of the mechanical grippers on the revolving endless conveyor members. The speed of the moving tapes, belts or chains of the endless guiding members is thus substantially equal to or less than the speed of the grippers, so that damage to the printed image is avoided.

In accordance with an added feature of the invention, the endless guiding members are formed with recesses for receiving the mechanical grippers therein. The moving tapes, belts or chains of the endless guiding members are of generally flat construction, and are thus formed with recesses in regions thereof engageable by the grippers.

In accordance with an additional feature of the invention, the endless guiding members are positionable transversely to the conveying direction for adjusting to the format of the sheets.

In accordance with yet another feature of the invention, the revolving endless guiding members are three in number and are disposed parallel to one another, two of the endless guiding members being on the outside and one of the endless guiding members being inside therebetween, the two outside endless guiding members being adjustable so as to engage a nonprinted marginal region of the sheets, and the one inside endless guiding member being positionable at a location substantially midway between the outside endless guiding members.

In accordance with yet a further feature of the invention, all but at least one of the endless guiding members are revolvable at a speed in synchronism with the speed of the mechanical grippers on the revolving endless conveyor members, and the at least one of the endless guiding members is revolvable at a speed lower than the synchronized speed.

In accordance with yet an added feature of the invention, the part of the endless conveyor members looped about the one of the rotating members is in the form of an arc greater than 90°.

In accordance with yet an additional feature of the invention, the endless guiding members disposed along the part of the endless conveyor members looped about the one of the rotating members extend in a direction of a plane tangential to the one of the rotating members, means are included for deflecting defective or proof sheets from the conveying direction into the direction of the tangential plane, and a container formed with a receiving opening is disposed in the direction of the tangential plane upstream of the sheet pile, as viewed in conveying direction of the sheets, for receiving in the container the defective or proof sheets deflected from the conveying direction.

In accordance with still another feature of the invention, the revolving endless guiding members have a lower side leading in the conveying direction, and an upper side trailing in the conveying direction, and the pneumatic means comprise at least one suction device disposed between the leading side and the trailing side of the revolving endless guiding members.

In accordance with still a further feature of the invention, the device includes means for controlling suction action of the suction device.

In accordance with still an added feature of the invention, the endless guiding members have a lower side leading in the conveying direction, and an upper side trailing in the conveying direction, and the pneumatic means comprise two separately controllable suction devices disposed between the leading side and the trailing side of the endless guiding members, one of the suction devices being disposed between the leading and the trailing sides in a region of the endless guiding members disposed in the direction of the tangential plane.

In accordance with still an additional feature of the invention, the pneumatic means comprise a suction device for exerting a force obliquely counter to the conveying direction of the sheets.

In accordance with a concomitant and alternative feature of the invention, the pneumatic means comprise a blower for exerting a force obliquely counter to the conveying direction of the sheets.

Thus, for adjusting to a defined sheet format or size, the moving tapes, belts or chains of the endless guiding members are positionable transversely to the conveying direction. If three parallel-arranged tapes, belts or chains of the endless guiding members are provided across the width of a sheet, it is then advantageous for the outermost one thereof to be positionable on the nonprinted marginal region of a sheet which is printed on both sides thereof, and the innermost tape, belt or chain to be positionable on the middle of the sheet. A special smoothening action can be performed upon the sheets if one of the tapes, belts or chains of the guiding members has a slower speed than that of those tapes, belts or chains which are moved in synchronism with the grippers. The same effect can also be attained by the blower or suction device if they, in addition to exerting force in the perpendicular direction, also exert force obliquely counter to the conveying direction of the sheets.

The wrapping or looped region for the moving tapes, belts or chains of the endless guiding members may advantageously be in the form of an arc greater than 90°. The moving tapes, belts or chains of the endless guiding members may trail off from the respective rotating members, about which the chains or belts which transport the grippers are looped, in the direction of a tangential plane in which there is located a reception opening of a container disposed upstream of the sheet pile for the waste or proof sheets which have been deflected out of the conveying direction.

As noted hereinbefore, a suction device may be disposed between the leading and trailing sides of the moving tapes, belts or chains of the endless guiding member, as viewed in sheet-conveying direction, with which that side of the sheet comes into contact which subsequently becomes the underside of the sheet when it comes to rest on the sheet pile. The suction action of this suction device may be variable by means of a control unit. The suction device may act as a deflector for the sheets if it is connected to two separately controllable suction-air sources, one of the suction-air sources acting in the region wherein the moving tapes, belts or chains of the endless guiding members trail off in the direction of the tangential plane towards the receiving opening of the container for the deflected sheets.

Other features which are considered as characteristic for the invention are set forth in the appended claims.

Although the invention is illustrated and described herein as embodied in a device for conveying sheets from a printing press to a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing, in which there is shown a delivery of a sheet-fed printing press incorporating the device according to the invention.

Referring now to the single FIGURE of the drawing, there is shown therein a sheet delivery having mechanical grippers 1, wherein the front or leading edge of a respective sheet 2 to be delivered or deposited onto a sheet pile 8 is held. A plurality of grippers 1 are disposed on respective gripper bars 3 extending transversely to the transport direction, three of the gripper bars 3 and respective grippers 1 thereof being secured to two parallel-extending chains 4, only one of which is represented diagrammatically by phantom lines in the FIGURE. The chains 4 travel over respective pairs of sprocket wheels 5 and 6 having respective axes of rotation extending horizontally and disposed parallel to one another. The sheets 2 are transported from a last impression cylinder 7 of a sheet-fed printing press onto a sheet pile or stack 8 which is disposed below an underside 9 of the chain delivery. One of the sprocket wheels 5 or 6 is coupled with a non-illustrated conventional drive. For guiding the sheets along the upper side 10 of the sheet delivery and for deflecting the sheets in the vicinity of the sprocket wheels 6, moving endless suction belts 14 are provided adjacent to a partial length 11 of the upper side 10 of the endless chains 4, along a so-called looping or wrapping region 12, and in a tangentially trailing region 13. The suction belts 14 are formed with recesses 15 in the vicinity of the gripper bars 3 and are looped about deflection elements 16 and 17. The speed of the suction belts 14 is equal to the speed of the chains 4. Between the side or strand 18 of the suction belts 14 which is moving in the transport direction and the side or strand 19 thereof which is moving in a direction opposite to the transport direction, two suction devices 20 and 21 are provided. The suction devices 20 and 21 communicate with a vacuum generator 24 via conventionally controllable valves 22 and 23.

A take-up or inlet opening 25 of a V-shaped container 26 for spoiled or waste sheets or test or proof sheets 27 is located in an extension of the tangentially trailing region 13 of the suction belts 14. The container 26 has one side wall 28 extending parallel to and in front of the sheet pile 8 and is disposed so that it is swivelable out of the way for pile changing. In the looping or wrapping region 12 and in the trailing region 13 of the suction belts 14, there is provided a gripper control cam 29 which is movable radially to the sprocket wheel 6. When a sample or proof sheet is removed, the gripper control cam 29 can be moved outwardly by means of a conventional actuating device, so that a gripper cylinder 31 secured to the gripper bar 3 by a roller lever 30 causes the grippers 1 to open. Signals introducible from the outside may be fed in a conventional manner to the actuating device for the gripper control cam 29 so that it removes a sample or proof sheet. In the delivery, photoelectric devices for detecting defective sheets and for detecting sheets which have been printed out of register generate a signal to reject a waste sheet which may be fed to the actuating device for the gripper control cam 29 and serve to trigger the valve 23.

The sheets 2 are transported away from the impression cylinder 7 on the upper side or strand 10 of the endless chains 4. On the lower side 18 of the suction belts 14, which travel at the same speed as that of the chains 4, the sheets 2 are guided on the suction belt 14 by means of the suction device 20, without smearing. Sheet reversal in the vicinity of the sprocket wheel 6 is effected without collision with any parts whatsoever in the delivery, so that the sheet 2 can be deposited on the sheet pile 8 against a stop 32 for the front or leading edge of the sheet without mechanical damage.

I claim:

1. Device for conveying sheets from a printing press to a sheet pile, comprising revolving endless conveyor members looped about at least two rotating members having respective horizontal axes of rotation disposed parallel to one another, one of the rotating members being disposed at a location remote from the printing press, mechanical grippers carried by the endless conveyor members for gripping only respective leading edges of sheets, said endless conveyor members having respective upper sides moving along a conveying path in a given conveying direction for carrying thereon sheets conveyable away from the printing press, revolving endless guiding members disposed over part of said conveying path along and adjacent said upper side of said endless conveyor members and along a part of said endless conveyor members looped about said one of said rotating members disposed at said location of said endless conveyor members remote from the printing press, and pneumatic means disposed along said endless guiding members for exerting a force in a direction substantially perpendicular to said conveying direction upon the respective sheets being conveyed, said endless conveyor members having an underside, and the sheet pile being disposed below said underside of said endless conveyor members.

2. Device according to claim 1, wherein said endless guiding members are revolvable at a speed at most substantially equal to the speed of said mechanical grippers on said revolving endless conveyor members.

3. Device according to claim 1, wherein each of said endless guiding members is a belt, a tape or a chain.

4. Device according to claim 3, wherein said endless guiding members are formed with recesses for receiving said mechanical grippers therein.

5. Device according to claim 3, wherein said endless guiding members are positionable transversely to said conveying direction for adjusting to the format of the sheets.

6. Device according to claim 3, wherein said revolving endless guiding members are three in number and are disposed parallel to one another, two of said endless guiding members being on the outside and one of said endless guiding members being inside therebetween, said two outside endless guiding members being adjustable so as to engage a nonprinted marginal region of the sheets, and said one inside endless guiding member being positionable at a location substantially midway between said outside endless guiding members.

7. Device according to claim 3, wherein all but at least one of said endless guiding members are revolvable at a speed in synchronism with the speed of said mechanical grippers on said revolving endless conveyor members, and said at least one of said endless guiding members is revolvable at a speed lower than said synchronized speed.

8. Device according to claim 1, wherein said part of said endless conveyor members looped about said one of said rotating members is in the form of an arc greater than 90°.

9. Device according to claim 8, wherein said endless guiding members disposed along said part of said endless conveyor members looped about said one of said rotating members extend in a direction of a plane tangential to said one of said rotating members, and including means for deflecting defective or proof sheets from said conveying direction into said direction of said tangential plane, and a container formed with a receiving opening disposed in said direction of said tangential plane upstream of said sheet pile, as viewed in conveying direction of the sheets, for receiving in said container the defective or proof sheets deflected from said conveying direction.

10. Device according to claim 1, wherein said revolving endless guiding members have a lower side leading in said conveying direction, and an upper side trailing in said conveying direction, and said pneumatic means comprise at least one suction device disposed between said leading side and said trailing side of said revolving endless guiding members.

11. Device according to claim 10, including means for controlling suction action of said suction device.

12. Device according to claim 9, wherein said endless guiding members have a lower side leading in said conveying direction, and an upper side trailing in said conveying direction, and said pneumatic means comprise two separately controllable suction devices disposed between said leading side and said trailing side of said endless guiding members, one of said suction devices being disposed between said leading and said trailing sides in a region of said endless guiding members disposed in said direction of said tangential plane.

13. Device according to claim 1, wherein said pneumatic means comprise a suction device for exerting a force obliquely counter to said conveying direction of the sheets.

14. Device according to claim 1, wherein said pneumatic means comprise a blower for exerting a force obliquely counter to said conveying direction of the sheets.

* * * * *